US007415229B2

(12) United States Patent
Gross et al.

(10) Patent No.: US 7,415,229 B2
(45) Date of Patent: Aug. 19, 2008

(54) METHOD AND SYSTEM FOR IMPROVED IMPLEMENTATION OF MAINTENANCE ROUTINES IN A PRODUCTIVE SYSTEM

(75) Inventors: Eric Gross, Rochester, NY (US); Palghat Ramesh, Pittsford, NY (US); Barrett Gady, Washington, IA (US); Eric Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 147 days.

(21) Appl. No.: 11/174,376

(22) Filed: Jun. 30, 2005

(65) Prior Publication Data

US 2007/0003324 A1 Jan. 4, 2007

(51) Int. Cl.
*G03G 15/08* (2006.01)

(52) U.S. Cl. ..... 399/257; 399/27

(58) Field of Classification Search ..... 399/27, 399/257

See application file for complete search history.

(56) References Cited

U.S. PATENT DOCUMENTS

| | | | | | |
|---|---|---|---|---|---|
| 5,956,542 | A * | 9/1999 | Budnik et al. | ..... | 399/29 |
| 6,047,142 | A * | 4/2000 | Donaldson | ..... | 399/27 |
| 6,160,970 | A * | 12/2000 | Scheuer et al. | ..... | 399/58 |
| 6,167,213 | A * | 12/2000 | Buranicz et al. | ..... | 399/58 |
| 6,175,698 | B1 * | 1/2001 | Scheuer et al. | ..... | 399/58 |
| 6,404,997 | B1 * | 6/2002 | Grace | ..... | 399/27 |
| 6,871,029 | B2 * | 3/2005 | Brewington et al. | ..... | 399/27 |
| 7,079,794 | B2 * | 7/2006 | Forbes et al. | ..... | 399/257 |
| 7,177,557 | B2 * | 2/2007 | Kreckel | ..... | 399/27 |
| 2004/0170441 | A1 * | 9/2004 | Forbes et al. | ..... | 399/27 |
| 2004/0170442 | A1 * | 9/2004 | Forbes et al. | ..... | 399/27 |
| 2004/0213593 | A1 * | 10/2004 | Brewington et al. | ..... | 399/27 |
| 2005/0286917 | A1 * | 12/2005 | Martin et al. | ..... | 399/27 |
| 2006/0222382 | A1 * | 10/2006 | Gady et al. | ..... | 399/27 |

* cited by examiner

*Primary Examiner*—David M Gray
*Assistant Examiner*—Ryan D. Walsh
(74) *Attorney, Agent, or Firm*—Fay Sharpe LLP

(57) ABSTRACT

The presently described embodiments relate to improving system productivity where maintenance purge routines are required through use of a digital front end (DFE) job scheduler. This approach utilizes knowledge of future jobs to maximize productivity. So, even if a low coverage area job is being processed, and a purge routine is scheduled, the purge routine may be avoided. This is achieved by projecting the system evolution over a future time horizon and determining the schedule of toner purge events (a non productive dead cycle) to minimize a cost function that penalizes the purge event (dead cycling and material loss should be minimized) and the deviation of average toner resident time in the sump from some desired set point of range. In this regard, knowledge that a high coverage area job is downstream and average toner residient time may be advantageously used to effectively perform the purge itself while in productive mode. The system gains knowledge of whether low coverage area jobs or high coverage area jobs are pending by using information stored within the print job file (e.g., a page description language job file). For example, a page description language (PDL) file typically includes information on the area coverage trajectory over time. This will allow a system to generate a predictive model which can constantly recalculate statistics based on knowledge of currently running jobs, new jobs or a change in customer criteria.

10 Claims, 3 Drawing Sheets

METHOD AND SYSTEM FOR IMPROVED IMPLEMENTATION OF MAINTENANCE ROUTINES IN A PRODUCTIVE SYSTEM

BACKGROUND

In traditional printing systems, where toner is used to provide marks on paper, the toner is typically housed within a cartridge in the system. The toner may also be transferred to a sump for use in the printing process. Since not all of the toner is used during each printing cycle, amounts of the toner may be resident within the cartridge or sump for extended periods of time. During this time, the unused toner may become electromechanically fatigued.

Accordingly, many types of print engines require a periodic purge of toner from the housing to maintain image quality. A purge routine is a non-productive printing mode, from a document processing standpoint, in which a high area coverage equivalent of toner is developed and sent to a cleaner. No printing occurs during this non-productive mode, or dead cycle, so as not to interfere with print jobs.

More particularly, during the purge cycle, the sump in the system is emptied of the toner by developing the toner onto a photoreceptor. The toner on the photoreceptor is then cleaned off the photoreceptor or printed onto paper. The sump is then refilled with fresh toner. The functions of emptying and refilling could be done concurrently or sequentially in traditional purging systems. This maintenance routine, though, results in an overall productivity reduction. Although net productivity (when image quality is considered) may be increased, overall productivity (also taking into account raw throughput) is still typically not achieved to desired levels.

Further, purge routines are typically triggered when some metric exceeds a threshold and is halted when either the same or different metric crosses a halting threshold (it may be as simple as an elapsed period of time). Example trigger metrics used in the past have been percent toner concentration (% tc) (which is a sensed value of the mass of toner particles over the mass of carrier particles) and toner age (an estimate of the average residient time population of toner particles in the sump). The purge routine will manage the metrics within some operable range.

In at least some situations, the goal is to maintain the average time of residence for toner within the sump to less than some upper threshold, for example, eighty (80) minutes. Algorithms have been implemented to calculate average residence time of toner within a sump or cartridge. However, when the purge process is used to maintain this average below an upper threshold value, there is a resulting drop in production. For example, a system that normally processes 100 prints per minute may only achieve a productivity level of 95 prints per minute when document area coverages are such that purging is triggered frequently. As such, the customers may not be satisfied. It is, therefore, desirable to reduce the productivity cost of the dead cycle while maintaining adequate image quality.

To improve productivity, a purge-while-run routine has also been proposed. This method continually develops additional images outside of the customer zone. Though possibly effective, it is expected that purge-while-run will strain cleaner latitude and, that for most pitch modes, the additional area to develop toner outside the customer zone is severely limited.

BRIEF DESCRIPTION

In one aspect of the presently described embodiments, a method for initiating a toner purge routine in an image rendering system comprises setting a target corresponding to a target age of toner, calculating an average age of a supply of toner, determining a projected average age of the supply of toner, computing a schedule of purge cycles over a selected period of time based on the determining, and, selectively performing the toner purge cycle base on the target.

In another aspect of the presently described embodiments, the target age of toner is approximately eighty (80) minutes.

In another aspect of the presently described embodiments, the calculating is based on a past history of coverage areas of print jobs and toner concentration.

In another aspect of the presently described embodiments, the determining is based on coverage area of future print jobs and toner concentration.

In another aspect of the presently described embodiments, the computing of the schedule is based on coverage area of future print jobs.

In another aspect of the presently described embodiments, the method further comprises determining the schedule so as to minimize a cost function.

In another aspect of the presently described embodiments, an image rendering system having set therein a target value corresponding to a target age of toner comprises a toner supply device having a supply of the toner stored therein and a print controller operative to calculate an average age of the supply of the toner, determine a projected average age of the supply of toner, compute a schedule of purge cycles over a selected period of time based on the projecting and selectively perform the toner purge cycle base on the schedule.

In another aspect of the presently described embodiments, the target age of toner is approximately eighty (80) minutes.

In another aspect of the presently described embodiments, the print controller is operative to compute a schedule based on the coverage area of future print jobs.

In another aspect of the presently described embodiments, the print controller is operative to determine a schedule of purges so as to minimize a cost function.

In another aspect of the presently described embodiments, a method for initiating a toner purge routine in an image rendering system comprises setting a target corresponding to a target toner concentration, determining an actual toner concentration, determining a projected toner concentration, computing a schedule of purge cycles over a selected period of time based on the determining, and, selectively performing the toner purge cycle based on the target.

In another aspect of the presently described embodiments, the determining of actual toner concentration is based on a measurement.

In another aspect of the presently described embodiments, the determining of projected toner concentration is based on coverage area of future print jobs and a minimum allowable dispense rate.

In another aspect of the presently described embodiments, the computing of the schedule is based on a mass balance model.

In another aspect of the presently described embodiments, the method further comprises determining the schedule so as to minimize a cost function.

In another aspect of the presently described embodiments, an image rendering system having set therein a target value corresponding to a toner concentration comprises a toner supply device having a supply of the toner stored therein, and, a print controller operative to determine an actual toner concentration, determine a projected toner concentration of the supply of toner, compute a schedule of purge cycles over a selected period of time based on the determining and selectively perform the toner purge cycle base on the schedule.

In another aspect of the presently described embodiments, the actual toner concentration is based on a measurement.

In another aspect of the presently described embodiments, the projected toner concentration is based on a coverage area of future print jobs and a minimum allowable dispense rate.

In another aspect of the presently described embodiments, the schedule is based on a mass balance model.

In another aspect of the presently described embodiments, the print controller is operative to determine a schedule of purges so as to minimize a cost function.

DETAILED DESCRIPTION

The presently described embodiments relate to improving system productivity where maintenance purge routines are required through use of a job scheduler implemented in a digital front end (DFE) or a controller of an image rendering system such as a printer. This approach utilizes knowledge of future print jobs to maximize productivity. So, even if a low coverage area job is being processed, and a purge routine is scheduled, the purge routine may be avoided. In this regard, knowledge that a high coverage area job is downstream may be advantageously used by performing the high coverage area job, thereby lowering the average toner age while in a productive mode. The system gains knowledge of whether low coverage area jobs or high coverage area jobs are pending by using information stored within the print job file (e.g., a page description language job file). For example, a page description language (PDL) file typically includes information on the area coverage trajectory over time. This will allow a system to generate a predictive model which can constantly project system response (such as toner age trajectory or tc trajectory) based on knowledge of currently running jobs, new jobs or a change in customer criteria.

So, the presently described embodiments enhance productivity in the presence of a purge maintenance routine by, with the availability of future image content, predicting the future trajectory of the purge routine metric. The prediction is model-based utilizing information on area coverage trajectory, percent toner concentration in the sump, and the developed mass per unit area (a critical specification that is regulated by closed loop feedback). Based on the predicted behavior of the system, an optimal purge schedule can be forecasted and applied. The forecast and purge schedule is updated periodically as new information on area coverage, developed mass per unit area, and percent toner concentration is obtained. The schedule of purges is obtained by minimizing a cost function that penalizes the occurrence of purges for productivity loss and penalizes the system for deviations of toner age beyond some set point. For example, if the purge threshold has not been crossed yet, with knowledge that a high area coverage document will soon be rendered, forgoing the purge can be justified and will result from the computed schedule.

Figure 1:
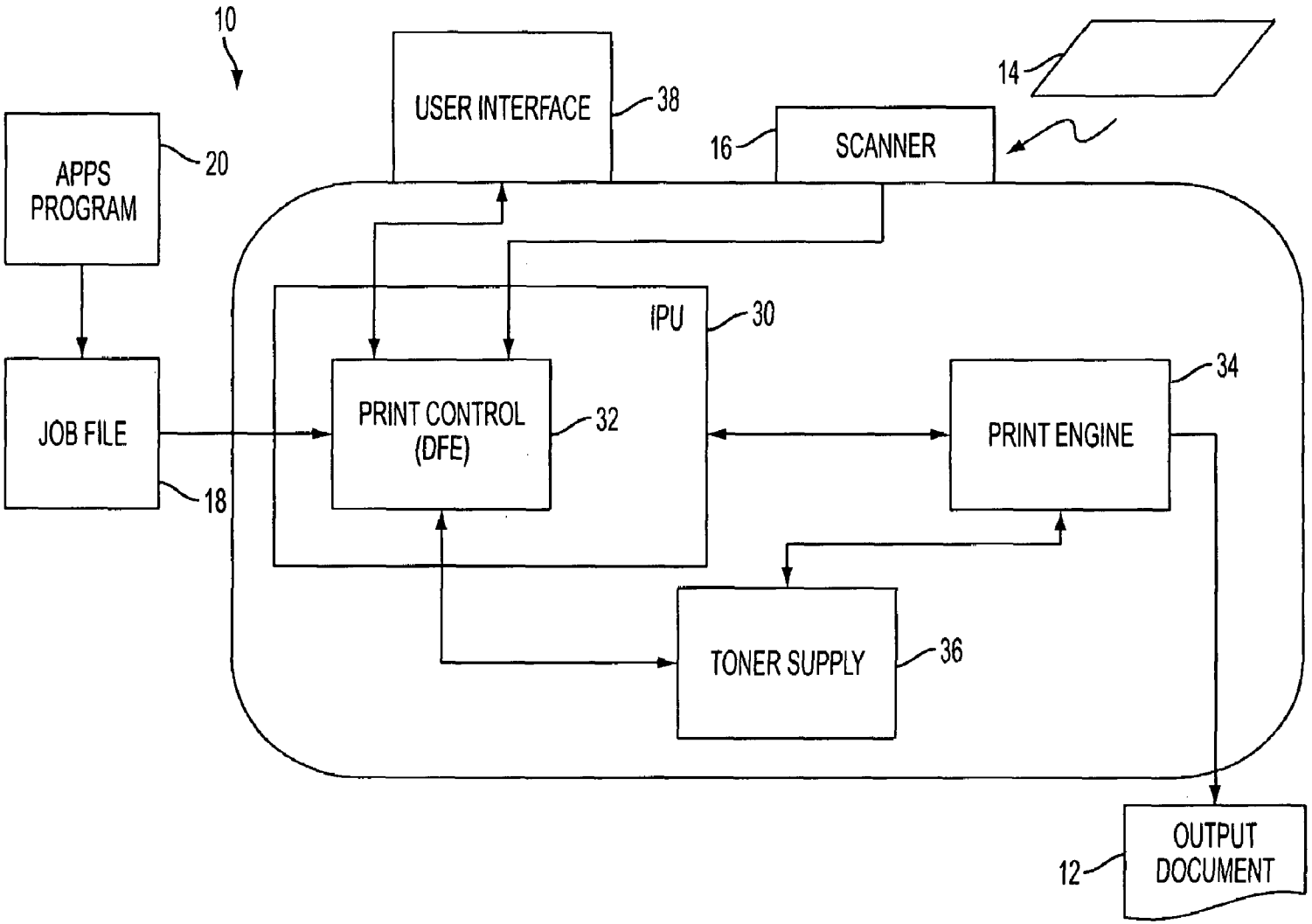
FIG. 1 is a block diagram of an image rendering system into which the presently described embodiments may be incorporated.

Referring to FIG. 1, an image rendering system 10 is illustrated. This system, which could take the form of a printer, copier, scanner/printer, facsimile machine, multipurpose device, bookmaking device or any other device which performs print outputting functions for any purpose . . . etc., is operative to generate an output document 12. In one form, such as a copier, the output document 12 is a copy based on an input document 14 that is scanned and digitized by a scanner 16. In another form, the output document 12 is a printed document based on a job file 18 that is generated by an applications program 20. In this case, the job file may be based on a page description language (PDL) specification.

In either case, or other possible scenarios, the input data is ultimately provided to an image processing unit (IPU) 30 having a digital front end (DFE) or print controller 32. As those skilled in the art will appreciate, the image processing unit (IPU) 30 communicates with and controls a print engine 34 which uses a toner supply 36 to produce a printed page or copy. Also shown is a user interface 38.

It will be appreciated that the system 10 can operate as a printer or copier, or other device, to convert input data of some form into an output document 12. The conventional techniques for doing so are well known in the art and will not be repeated herein for convenience. Moreover, the illustration of FIG. 1 is merely logical and representative in nature. It will be appreciated that the actual implementation of a printer, copier or other device may take a variety of different forms that will be apparent to those skilled in the art.

Notably, however, the system 10 illustrated in FIG. 1 has presently described embodiments incorporated therein. In this regard, the system is set-up to have a target value stored therein. This target value may correspond to a target age of toner at which a toner purge cycle may be desired to be implemented. Or, the target value may correspond to a toner concentration. This target value can be set through the user interface 38. Of course, techniques for doing so are well known in the art. However, it should be appreciated that the target value, in one form, is provided by the user interface 38 to the print control module 32. Along those lines, the print control module or digital front end (DFE) 32, in one form, is operative to calculate an average age of a supply of toner (or determine a toner concentration), determine a projected age (or determine a projected toner concentration) and selectively perform the toner purge cycle based on a schedule that is computed. In addition, the system 10 includes a toner supply 36 which may take the form of a sump or toner cartridge, depending on the configuration of the actual image rendering system.

It should be appreciated that the print control module 32 may be implemented using a variety of different software routines or techniques and hardware configurations. As shown, the print controller or digital front end (DFE) 32 is implemented within an image processing unit 30. Similarly, other logical modules illustrated in FIG. 1 may be implemented using software routines and techniques and/or hardware configurations that will vary from application to application.

Figure 2:
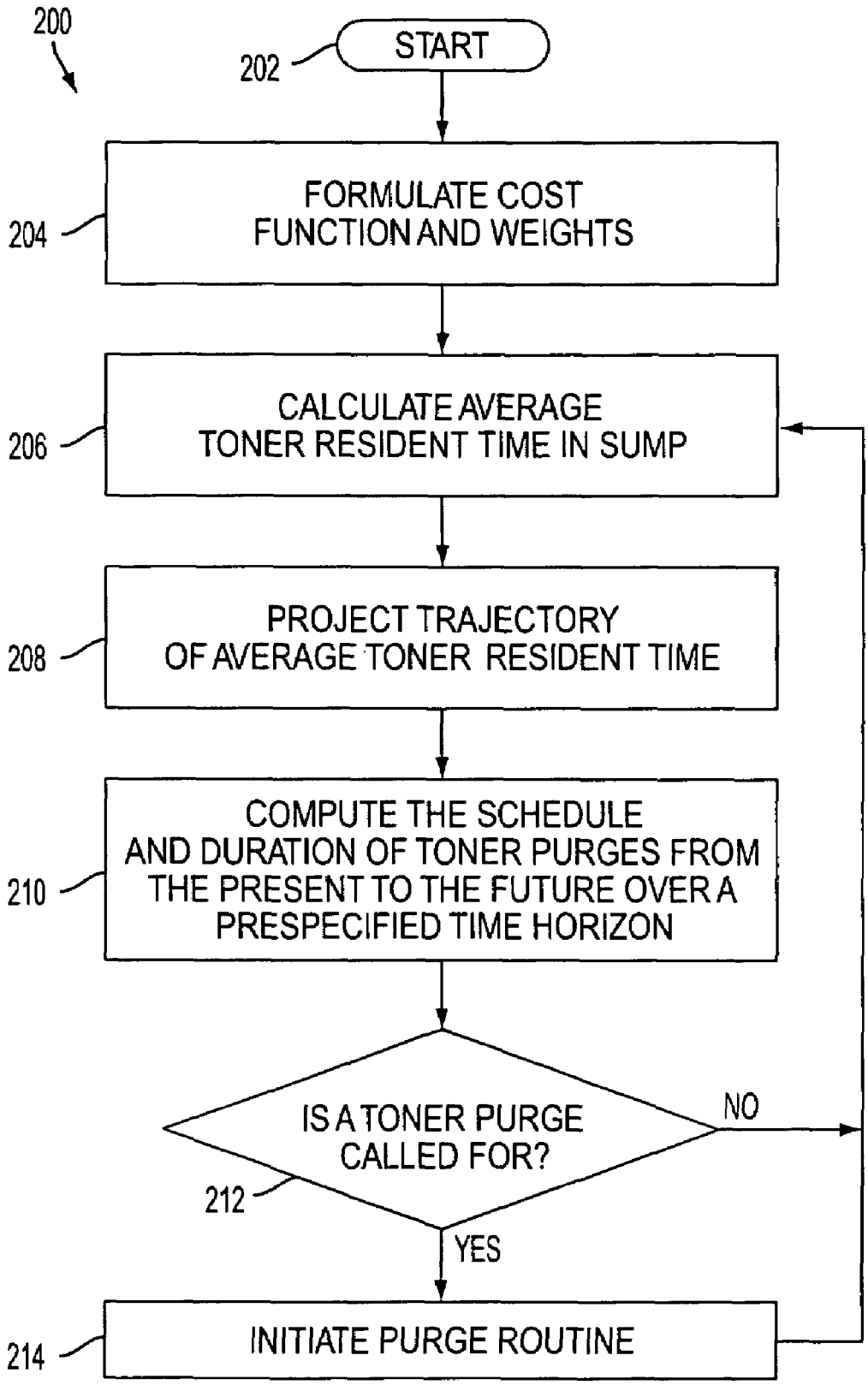
FIG. 2 is a flowchart illustrating a method according to the presently described embodiments; and, FIG. 3 is a flowchart illustrating a method according to the presently described embodiments.

Along these lines, a method according to the presently described embodiments is illustrated in FIG. 2. As alluded to above, this method may be implemented, in one form, within the print control module or digital front end (DFE) 32 and the various supporting elements of the system 10 of FIG. 1.

In this regard, a method 200 is started (at 202) and practically initiated by the formulation of a cost function and various weighting factors (as will be detailed below) (at 204). It should be appreciated that formulation of the cost function may be accomplished at the design stage of the system, in one form, and may vary as a function of measured or known parameters. This formulation, in one form, penalizes productivity loss due to purge and any deviations from a desired value or range, such as a target value for average residence time of toner. As to loss due to purge, the fact that purging is a non-productive mode is a factor in the formulation. It should also be understood that average toner resident time in the sump is inversely correlated to image quality. In this regard, the process includes the setting of a target or target value (the target can be considered a threshold value) by a user through the user interface 38. Again, this target value represents a target age of toner at which a purge cycle is desired to be implemented. In at least one form, the target value is approximately eighty (80) minutes. Of course, it should be appreciated that this target value can take a variety of other values such as forty (40) minutes, one hundred twenty (120) minutes, one hundred (100) minutes, . . . etc. The value is selected with image quality and productivity tradeoff considerations. The target value is provided by the user interface 38 to the image processing unit (IPU) 30, e.g., to the print controller or digital front end (DFE) 32. The target value or target may also be a range of values.

The system frequently computes the toner age (at 206), an estimate of the average residence time of a toner particle resident in the housing. In the implementation this computation occurs at 4 second intervals, though more frequent or less frequent update rates may be appropriate in other embodiments. It is to be appreciated that this determination could be initiated by the system according to a predetermined time period or it could be triggered by other events that occur, such as the printing of jobs of a particular size or the printing of a specific number of jobs. Techniques to compute toner age are well known in the art and need not be detailed here but typically include reference to toner concentration sensed and past history of toner area coverages available. Area coverage information is typically available in the DFE in, for example, units of pixel count per page.

Next, the average toner resident time or age in the sump is projected based on future toner concentration trajectories (based on a value from, for example, a toner concentration control system) and future area coverages (at 208). This projected age is, in one form, a series of ages progressing over a time period, e.g. a trajectory. Future area coverage information is available from the digital front end (DFE). Then, the system computes the schedule and duration of toner purges from the present to the future over a specified or selected time horizon or period to minimize the cost function (at 210). This computation is based on methodologies common in the art of Model Predictive Control. In one form, this is accomplished by using a toner-sump mass balance model of the system and knowledge of the area coverage of future prints (from DFE) determined at 208 from the present to the future over a specified time horizon and the toner age computed at 206.

Next, a determination is then made as to whether a purge routine is necessary (at 212). This is based on the calculated schedule. If a purge routine is not necessary, the process returns to calculating (at 206). If a purge routine is necessary, however, the purge routine is run in conventional manners (at 214). In this regard, the purge routine may be performed in a variety of well known manners. However, in one form, the toner is simply developed onto the photoreceptor of the printer and the photoreceptor is then cleaned by conventional techniques. In another form, after the toner is developed on the photoreceptor, pages of toner are simply printed to remove the toner from the photoreceptor. Of course, these pages are scrapped. In addition, it will be understood that the performance of the purge routine may be conducted concurrently with the refilling of the toner supply, e.g., to sump or cartridge, or this may be performed sequentially. In either case, purging of the toner, and cases where the printer is to be reused, is associated with a refilling of the toner supply. If, however, the coverage area is determined to be sufficient to forego initiation of the purge routine, then the process is simply recycled to the beginning of the process.

The scheduling (e.g. at 210) of these control actions contemplated by the presently described embodiments, e.g., a dead cycle and a toner purge to the photoreceptor which is necessary to refresh the toner in the sump, can be computed so as to minimize a predefined cost index as defined at 204.

The predefined cost index (or cost function and weights as described above), J, from the present time, k, out to the future over some time horizon, p, can be specified and computed for any given set of actuations [actuation(k), actuation(k+1), . . . actuation(k+p−1)]. Below is an example of one form of a cost index, J.

$$J = \sum_{L=1,p} \|W_1(k) * \max(0, TonerAge(k+L|k) - TonerAgeTarget(k+L)\|\text{^}2 + \sum_{L=1,p} \|W_2(k) * \text{Actuation}(k+L-1)\|\text{^}2$$

where for Actuation a 0 can indicate a do not purge at this time and a 1 can indicate an initiate a purge at this time. The terms $W_1(k)$ and $W_2(k)$ are weights that can be selected by the design engineer. The larger the value the greater is the penalty for deviations. The TonerAgeTarget is known and settable by the design engineer, and the TonerAge itself can be projected into the future based on the expected toner consumption which in turn is available from the digital front end that details the print job. The task is to determine the schedule of purges (the actuation set) so as to minimizing the cost function J. With knowledge of a given schedule of purges and the Toner Age trajectory over time, the cost index can be computed. The actuation set that minimizes the cost function (which is quadratic in the above example), can be determined by standard optimization procedures. The class of techniques are common in the art and this problem formulation and solution falls under the category of Model Predictive Control. The schedule of actuations is both implemented and updated periodically (the optimization is repeated) with updated toner age information and area coverage information used to project the system response over a future time horizon. Note that different toner purge solutions will result when changing the sequence or contents of the job mix.

Figure 3:
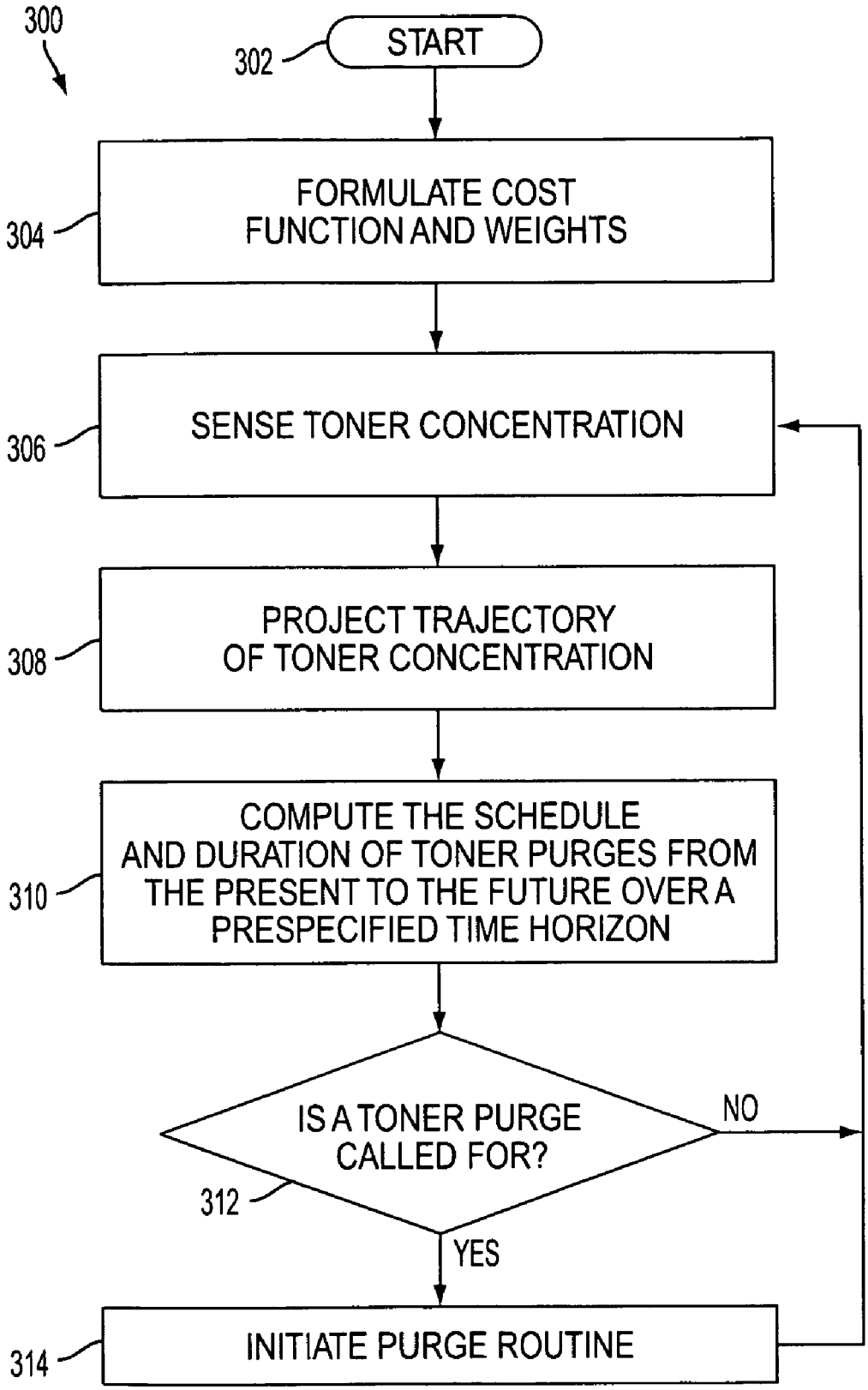

Another method according to the presently described embodiments is illustrated in FIG. 3. This method uses toner concentration as a target value, as opposed to toner age as in connection with FIG. 2. In this regard, a method 300 is started (at 302) and practically initiated by the formulation of a cost function and various weighting factors (as will be detailed below) (at 304). This formulation, in one form, penalizes productivity loss due to purge and any deviations from a desired value or range, such as a value for Toner Concentration. It should also be understood that toner concentration that is too high will produce emissions and toner concentration that is too low will yield prints that are too light. In this regard, the process includes the setting of a target value (the target can be considered a threshold value) by a user through the user interface 38. In at least one form, the target value is typically (4.5) percent toner concentration. Of course, it should be appreciated that this target value can take a variety of other values. The value is selected with image quality considerations.

The system measures the toner concentration directly with a toner concentration sensor. In the implementation, this measurement occurs at 4 second intervals, though more frequent or less frequent update rates may be appropriate in other embodiments (at 306). It is to be appreciated that this determination could be initiated by the system according to a predetermined time period or it could be triggered by other events that occur, such as the printing of jobs of a particular size or the printing of a specific number of jobs.

Next, the toner concentration in the sump is projected based on future area coverages and knowledge of the minimum allowable dispense rate (at 308). This projection is, in one form, a series of toner concentrations evolving over time to establish a trajectory. Future area coverage information is available from the digital front end (DFE). Then, the system computes the schedule and duration of toner purges that are necessary to reduce the Toner Concentration level to an acceptable level (at 310). This computation is based on methodologies common in the art of Model Predictive Control. In one form, this is accomplished by using a mass balance model of the system and knowledge of the area coverage of future prints (from DFE) from the present to the future over a specified time horizon. So for example, if the area coverage is 0% and the minimum dispense rate is at some known but non zero rate of mg/min, and the system is designed to try to regulate the toner concentration to 4.5%, then the toner concentration will increase linearly over time.

Next, a determination is then made as to whether a purge routine is necessary (at 312). This is based on the calculated schedule. If a purge routine is not necessary, the process returns to sensing the toner concentration in the sump (at 306). If a purge routine is necessary, however, the purge routine is run in conventional manners (at 314). In this regard, the purge routine may be performed in a variety of well known manners. However, in one form, the toner is simply developed onto the photoreceptor of the printer and the photoreceptor is then cleaned by conventional techniques. In another form, after the toner is developed on the photoreceptor, pages of toner are simply printed to remove the toner from the photoreceptor. Of course, these pages are scrapped. In addition, it will be understood that the performance of the purge routine may be conducted concurrently with the refilling of the toner supply, e.g., to sump or cartridge, or this may be performed sequentially. In either case, purging of the toner, and cases where the printer is to be reused, is associated with a refilling of the toner supply. If, however, it is determined to be sufficient to forego initiation of the purge routine, then the process is simply recycled to the beginning of the process.

This embodiment (e.g. FIG. 3) of calculation of the coverage area for scheduled print jobs is related to a minimum dispense feature and, as should be apparent from the description of FIG. 3, uses toner concentration as a target parameter. The minimum dispense algorithm is implemented to reduce the frequency and severity of low area coverage failures associated with some printing systems. This is achieved by not permitting the dispense rate to go below a specified minimum nonzero threshold regardless of area coverage. This scheme could eventually result in an overtone condition (for example if the document area coverage is below the minimum dispense threshold). An overtone condition will then trigger a detone dead cycle. In a narrow sense, the dead cycle is nonproductive. To delay an overtone condition, a tradeoff may be required between minimum dispense level (keep minimum dispense level as low as possible so as to keep overtone conditions as infrequent as possible) and IQ (the higher the minimum dispense level the better because it helps with solid area development and streaks reduction). If a known high area coverage document is known to be coming along in the queue, then one can afford a higher minimum dispense level since there will be no productivity loss associated with an overtone condition triggering a detone dead cycle (the upcoming high area coverage customer job will serve to detone the system). The means by which greater productivity may be had by adapting the minimum dispense level or by scheduling the detone dead cycling in real time can be achieved via the application of model predictive control techniques that seeks to minimize again a cost index that penalizes both the level of overtoning and the productivity loss that occurs during a detone dead cycle.

The technique of model predictive control will provide a systematic framework to determine optimal control actions. The optimal criteria must be specified in system levels terms that includes not only the maintenance of healthy development but also customer productivity (reducing purge and/or detone duration and rates). A large set of functional relationships that describe the maintenance of "healthy" development as a function of dispense, TC level, and area coverage time tracks can be handled in a unified manner. The computation of the dispense command is determined at each time step to satisfy a set of constraints (for example tc, dispense, and dispense changes, due both to hardware and xerographic failure modes) and to minimize a cost function. A formulation of a first principles based model on mass balance and possibly augmented with mixing dynamics is required.

Formulation:

At time k, for a given set of future actuation changes, $\Delta disp(k)$, $\Delta disp(k+1)$, $\Delta disp(k+2)$, . . .

The future behavior of the process outputs TC(k), TC(k+1), TC(k+2), . . .

(where TC stands for toner concentration) will be estimated over a time horizon p. The future process output response is based on a model which would include a disturbance model. The disturbance model would include the toner loss estimated from future area coverage information (future area coverage information at future time instants will be provided by the DFE). Note below that the choice of weights and constraints will explicitly depend on the future area coverage profile. So, for example, high TC levels just prior to a shift from low are coverage to high area coverage would not be heavily penalized since the TC level can easily return to nominal after the high area coverage transition occurs. Also, the minimum dispense constraint can be made a function of area coverage, reducing to 0 for the high area coverage runs.

The algorithm is such that the m ($m<p$) present and future actuation changes are determined (solving a quadratic program at each time instance) such that the following cost function is minimized.

$$Minimize_{\Delta disp(k),\ldots,\Delta disp(k+m-1)} \sum_{L=1,p} \|A(L)*(TC(k+L|k) - TCtarget(k+L)]\|^{\wedge 2} + \sum_{L=1,m} \Delta\|B(L)*\Delta disp(k+L-1)\|^2$$

Some example constraints on actuators and system output are listed below:

1. Disp_Min(L)<=disp(k=L)<=disp_Max(L), Minimum dispense lower limit to maintain developability and max dispense limit to ensure charge through can be incorporated here. These min and max dispense limits can be made a function of time (indicated by L). If a minimum dispense to Area Coverage relationship is established, Disp_Min=F(AC), then with future area coverage information Disp_Min=F(AC(L)).

2. Δdisp(k+L)<=Δdisp_Max(L), Imposes limits on the change in the dispense rate. May be beneficial in terms of mixing, i.e., preventing a developer "slugs" from creating large TC gradients within the housing.

TC_Min(L)<=TC(k+L|k)<=TC_Max(L), Constraints on the regulated variable. In the application here a lower threshold on TC can be imposed. An upper threshold is probably inappropriate (may be such that no solution exists to satisfy the constraints). Rather, a lower TC limit will be imposed to prevent reload defects and an upper TC level will be utilized to trigger a TC detone dead cycle.

The weights in the cost function MinimizeΔdisp(k), . . . , Δdisp(k+m−1) $\Sigma L=1,p\|A(L)*(TC(k+L|k)-TCTarget(k+L]\|^2+\Sigma L=1,m\|B(L)*\Delta disp(k+L-1)\|^2$, can be set as a function of future sequence of area coverage, that is the future set of disturbances. So, for example, if in the near term there will be a transition from low area coverage to high area coverage, then smaller weights on TC deviations from target can be used after the system transitions to high area coverage, Again, A(L) can be specified as a function of area coverage.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The claims may encompass embodiments in hardware, software, or a combination thereof.

The invention claimed is:

1. A method for scheduling a toner purge routine in an image rendering system, the method comprising:

setting a target corresponding to a target age of toner;

calculating an average age of a supply of toner;

determining a projected average age of the supply of toner;

computing a schedule of purge cycles over a selected period of time based on the determining; and, selectively performing the toner purge cycle based on the target.

2. The method as set forth in claim 1 wherein the target age of toner is approximately eighty (80) minutes.

3. The method as set forth in claim 1 wherein the calculating is based on a past history of coverage areas of print jobs and toner concentration.

4. The method as set forth in claim 1 wherein the determining is based on coverage area of future print jobs and toner concentration.

5. The method as set forth in claim 1 wherein the computing of the schedule is based on coverage area of future print jobs.

6. The method as set forth in claim 1 further comprising determining the schedule so as to minimize a cost function.

7. An image rendering system, the system having set therein a target value corresponding to a target age of toner, the system comprising:

a toner supply device having a supply of the toner stored therein; and, a print controller operative to calculate an average age of the supply of the toner, determine a projected average age of the supply of toner, compute a schedule of purge cycles over a selected period of time based on the projecting and selectively perform the toner purge cycle based on the schedule.

8. The system as set forth in claim 7 wherein the target age of toner is approximately eighty (80) minutes.

9. The system as set forth in claim 7 wherein the print controller is operative to compute a schedule based on the coverage area of future print jobs.

10. The system as set forth in claim 7 wherein the print controller is operative to determine a schedule of purges so as to minimize a cost function.

* * * * *